US011166110B2

(12) United States Patent
El Guindi et al.

(10) Patent No.: US 11,166,110 B2
(45) Date of Patent: Nov. 2, 2021

(54) HEARING AID AND METHOD FOR CONTROLLING A POWER MODE THEREOF

(71) Applicant: Sonova AG, Stafa (CH)

(72) Inventors: Nadim El Guindi, Zurich (CH); Nina Stumpf, Mannedorf (CH); Hilmar Meier, Zurich (CH); Hans-Ueli Roeck, Hombrechtikon (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/830,488

(22) Filed: Mar. 26, 2020

(65) Prior Publication Data

US 2020/0314561 A1 Oct. 1, 2020

(30) Foreign Application Priority Data

Mar. 27, 2019 (EP) ..... 19 165 499

(51) Int. Cl.
*H04R 25/00* (2006.01)
*H04R 1/10* (2006.01)

(52) U.S. Cl.
CPC ..... *H04R 25/305* (2013.01); *H04R 1/1041* (2013.01); *H04R 25/407* (2013.01); *H04R 25/554* (2013.01); *H04R 2225/41* (2013.01); *H04R 2225/61* (2013.01); *H04R 2460/03* (2013.01)

(58) Field of Classification Search
CPC .. H04R 1/1041; H04R 25/407; H04R 25/554; H04R 2499/13; H04R 2225/41; H04R 2225/61; H04R 2460/03; H04R 25/305
USPC ..... 381/57, 302, 56, 86, 314, 323
See application file for complete search history.

(56) References Cited

U.S. PATENT DOCUMENTS

| | | | | |
|---|---|---|---|---|
| 4,955,729 | A | 9/1990 | Marx | |
| 10,524,082 | B1 * | 12/2019 | Carroll | G01P 15/08 |
| 2014/0321682 | A1 * | 10/2014 | Kofod-Hansen | H04R 25/30 381/315 |
| 2015/0230036 | A1 * | 8/2015 | Pedersen | H04R 25/305 381/330 |

FOREIGN PATENT DOCUMENTS

| | | | |
|---|---|---|---|
| EP | 2 840 810 | A2 | 2/2015 |
| EP | 2 908 550 | A1 | 8/2015 |
| WO | 2017/157409 | A1 | 9/2017 |
| WO | WO 2017/157409 | * | 9/2017 |

OTHER PUBLICATIONS

European Search Report for 19 16 5499 dated Aug. 1, 2019.

* cited by examiner

*Primary Examiner* — Norman Yu
(74) *Attorney, Agent, or Firm* — Pearne & Gordon LLP

(57) ABSTRACT

A hearing aid, including an inertial sensor for detecting movement of the hearing aid, and a power mode controller connected to the inertial sensor through a threshold comparison unit and adapted to switch the hearing aid off or into a low power mode if the threshold comparison unit detects that a characteristic of a signal including information on the movement detected by the inertial sensor is below a certain threshold. Also, a method for controlling a power mode of a hearing aid.

15 Claims, 4 Drawing Sheets

HEARING AID AND METHOD FOR CONTROLLING A POWER MODE THEREOF

The invention relates to a hearing aid and method for controlling a power mode thereof.

BACKGROUND OF THE INVENTION

Hearing aids are battery powered devices. In order to save battery power and for convenience of the user (for some users it is difficult to handle the power off button on a hearing instrument), it may be desirable to automatically switch the hearing aid off when not in use.

There remains a need for an improved hearing aid and an improved method for controlling a power mode thereof.

SUMMARY OF THE INVENTION

It is an object of the present invention to provide an improved hearing aid and an improved method for controlling a power mode thereof.

The object is achieved by a hearing aid according to claim 1 and by a method according to claim 10.

Preferred embodiments of the invention are given in the dependent claims.

A hearing aid according to the invention comprises:

an inertial sensor for detecting movement, e.g. an acceleration and/or orientation, of the hearing aid, a power mode controller connected to the inertial sensor through a threshold comparison unit and adapted to switch the hearing aid off or into a low power mode if the threshold comparison unit detects that a characteristic of a signal comprising information on the movement detected by the inertial sensor is below a certain threshold.

The inertial sensor can comprise an accelerometer and/or a gyroscope.

In an exemplary embodiment, the hearing aid further comprises:

at least one microphone, a receiver, a feedback canceller adapted to determine a feedback gain between the receiver and the at least one microphone, an out of ear detector configured to determine, based on whether the feedback gain is greater than a certain feedback gain threshold, if the hearing aid is in a user's ear or not and, if the hearing aid is determined as not being in the user's ear, to increase the threshold used by the threshold comparison unit and/or to enable operation of the threshold comparison unit and/or to alter at least one time constant used by a motion detection unit to average the signals from the inertial sensor before forwarding them to the threshold comparison unit.

In an exemplary embodiment, the out of ear detector is configured to use a feedback gain threshold of about −50 dB to distinguish if the hearing aid is in a user's ear or not.

In an exemplary embodiment, the out of ear detector is configured to adapt the feedback gain threshold based on whether the fitting of the hearing aid is rather occluded or open.

In some embodiments, the hearing aid may comprise a vent, in particular an active vent, and an acoustic valve operationally coupled to the vent such that an effective size of the vent can be changed by the acoustic valve. The vent can provide venting between an inner region of an ear canal and an ambient environment outside the ear canal when the hearing aid is at least partially inserted into the ear canal.

The amount of venting provided by the vent can depend on the effective size of the vent. In such a hearing aid, the out of ear detector may be configured to adapt the feedback gain threshold based on the effective size of the vent. In particular, the feedback gain threshold can be decreased when the effective size of the vent is more reduced, for instance when the vent is fully closed. Reversely, the feedback gain threshold can be increased when the effective size of the vent is more enlarged. The hearing aid can comprise an electrical actuator configured to actuate the acoustic valve to change the effective size of the vent.

In an exemplary embodiment, the feedback canceller or the out of ear detector is configured to average the feedback gain over time at least in a selected frequency range before comparing with the feedback gain threshold.

In an exemplary embodiment, a bandpass filter is configured to filter the signals from the inertial sensor to detect body activity of a user.

In an exemplary embodiment, the hearing aid further comprises an environment classification unit configured to detect, based on signals from the at least one microphone, whether the hearing aid is in a moving vehicle and to:

adapt a frequency selectivity of the bandpass filter in this case such that typical acceleration patterns from moving vehicles are attenuated, and/or adapt the threshold to account for typical acceleration patterns from moving vehicles.

In an exemplary embodiment, a hearing aid, in particular as described above comprises:

an inertial sensor, a power mode controller, a correlation analyzer unit connected to a motion detection unit, a wireless interface, wherein the motion detection unit is configured to detect an impact shock, in particular generated by an impact of a cover of a storage box or charger against the hearing aid when closing the cover, wherein the correlation analyzer unit is configured for binaural data exchange with another hearing aid having the same configuration through the wireless interface and to share shock data upon detection of the impact shock with the other hearing aid, wherein the correlation analyzer unit is configured to allow the power mode controller to switch the hearing aid off or into a low power mode upon synchronous detection of impact shocks in both hearing aids.

In an exemplary embodiment, the hearing aid is configured to measure a power of the wireless transmission from the other hearing aid, wherein the correlation analyzer unit is alternatively or additionally configured to allow the power mode controller to switch the hearing aid off or into a low power mode if the power is greater than a certain power threshold.

In an exemplary embodiment, the hearing aid further comprises:

at least one microphone connected to the correlation analyzer unit, wherein the correlation analyzer unit is configured to detect a click in the signals from the at least one microphone, in particular a click generated by a lock of a charger or storage box snapping in, and to allow the power mode controller to switch the hearing aid off or into a low power mode if the click is synchronous with a click determined in the other hearing aid and/or preceded by the impact shock.

In an exemplary embodiment, the hearing aid further comprises:

an NFC handler connected to the correlation analyzer unit and configured to communicate with an NFC chip in a charger or storage box, wherein the correlation analyzer unit is alternatively or additionally configured to allow the power mode controller to switch the hearing aid off or into a low power mode if the NFC handler has established a communication with an NFC chip.

The signals analysed by the threshold comparison unit or correlation analyzer unit can be acquired directly from the inertial sensor or indirectly via one or more intermediate signal processing components such as filters.

The signal characteristic may comprise at least one of an amplitude, a magnitude, a frequency, and an energy of the signal. The signal characteristic can be representative for the movement detected by the inertial sensor, in particular at least one of a motion energy, a velocity, an acceleration, an angular momentum of the hearing aid and/or the like. The signal evaluated by the threshold comparison unit may be filtered, in particular frequency filtered, or unfiltered.

According to the invention, a method for controlling a power mode of a hearing aid comprises:

comparing by means of a threshold comparison unit, if a characteristic of a signal comprising information on a movement detected by an inertial sensor of the hearing aid is below a certain threshold and switching the hearing aid off or into a low power mode in this case.

In an exemplary embodiment, the method further comprises:

determining a feedback gain between a receiver and at least one microphone, determining, based on whether the feedback gain is greater than a certain feedback gain threshold, if the hearing aid is in a user's ear or not and, if the hearing aid is determined as not being in the user's ear, to increase the motion energy threshold and/or to enable operation of the threshold comparison unit and/or to alter at least one time constant used to average the signals from the inertial sensor before forwarding them to the threshold comparison unit.

In an exemplary embodiment, the method further comprises:

adapting the feedback gain threshold based on whether the fitting of the hearing aid is rather occluded or open.

In an exemplary embodiment, the method further comprises:

bandpass filtering the signals from the inertial sensor to detect body activity of a user.

In an exemplary embodiment, the method further comprises:

detecting, based on signals from the at least one microphone, whether the hearing aid is in a moving vehicle and:

adapting a frequency selectivity of the bandpass filter in this case such that typical acceleration patterns from moving vehicles are attenuated, and/or adapting the threshold to account for typical acceleration patterns from moving vehicles.

In an exemplary embodiment, a method for controlling a power mode of a hearing aid, in particular one of the methods described above, comprising:

detecting an impact shock, in particular generated by an impact of a cover of a storage box or charger against the hearing aid when closing the cover, binaural data exchange with another hearing aid having the same configuration through a wireless interface to share shock data upon detection of the impact shock with the other hearing aid, switching the hearing aid off or into a low power mode upon synchronous detection of impact shocks in both hearing aids.

In an exemplary embodiment, the method further comprises:

measuring a power of the wireless transmission from the other hearing aid, switching the hearing aid off or into a low power mode if the power is greater than a certain power threshold.

In an exemplary embodiment, the method further comprises:

detecting a click in the signals from the at least one microphone, in particular a click generated by a lock of a charger or storage box snapping in, switching the hearing aid off or into a low power mode if the click is synchronous with a click determined in the other hearing aid and/or preceded by the impact shock.

In an exemplary embodiment, the method comprises:

alternatively or additionally switching the hearing aid off or into a low power mode if an NFC handler of the hearing aid has established a communication with an NFC chip, in particular in a charger or storage box.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

Corresponding parts are marked with the same reference symbols in all figures.

DETAILED DESCRIPTION OF PREFERRED EMBODIMENTS

Figure 1:
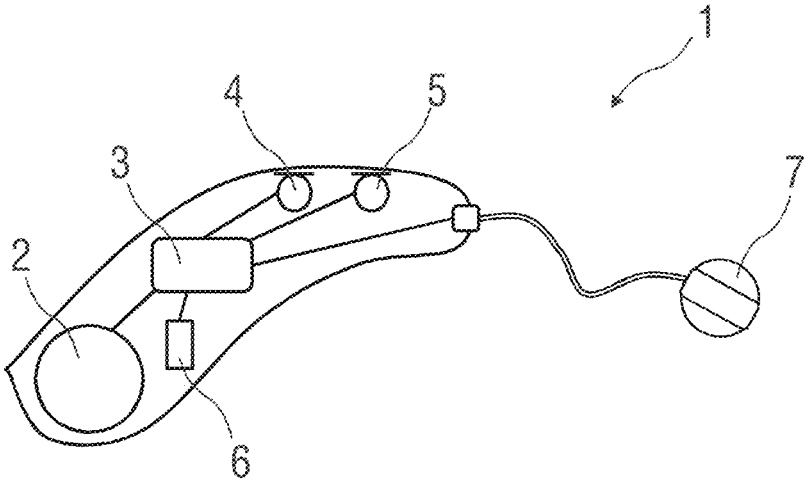
FIG. 1 is a schematic view of a hearing aid.
Figure 2:
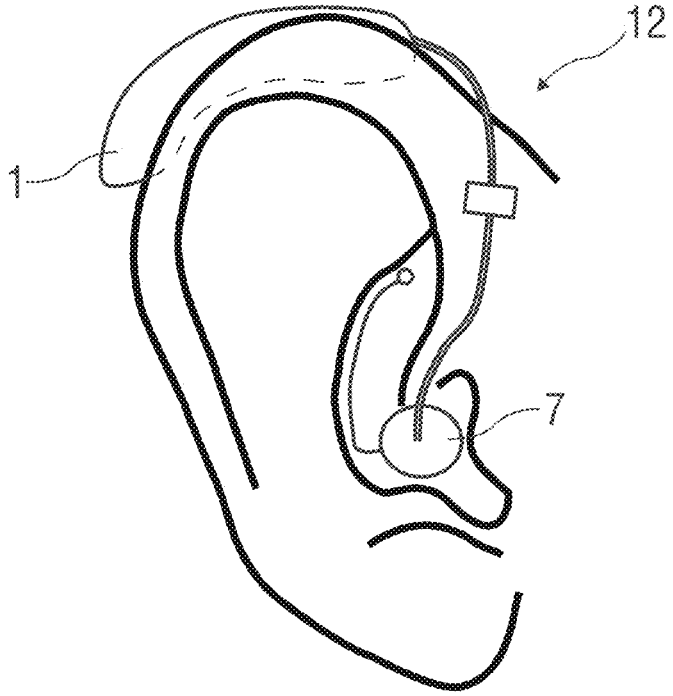
FIG. 2 is a schematic view of a hearing aid applied in a user's ear.

FIG. 1 is a schematic view of a hearing aid 1 comprising a battery 2, a processor 3, a first microphone 4, optionally a second microphone 5, an inertial sensor 6 and a receiver 7 with a speaker. FIG. 2 is a schematic view of the hearing aid 1 applied in a user's ear 12. The hearing aid 1 may be an RIC hearing aid (receiver in the canal).

In order to save battery power and for convenience of the user (for some users it is difficult to handle the power off button on a hearing instrument), the hearing aid 1 may include a power mode controller 8 to power off or switch into a low power mode automatically when not in use. The condition "not in use" can be detected inter alia by the inertial sensor 6 which can be used to provide sensory input to such detection. Furthermore, the acoustic input signal from at least one of the microphones 4, 5 can be used.

Depending on the resolution or sensitivity of the inertial sensor 6 (which is usually a tradeoff with the power consumption of the inertial sensor) it can be detected whether the hearing aid 1 is in the ear 12 of the user or not in use, e.g. lying on a table. Thus, when the user takes off the hearing aid 1 and puts it on a table (e.g. on the night table when going to bed) the hearing aid 1 can detect that and turn automatically off or into a low power mode. The power off or low power function may be based on a characteristic of a signal comprising information on a movement detected by the inertial sensor, e.g. detection of motion, below a certain threshold, e.g. by a threshold comparison unit 11. It is desirable to avoid that the hearing aid 1 powers off while in the ear 12 of the user.

In an exemplary embodiment, information from a feedback canceller 9 can be used in an out of ear detector 10, namely the feedback gain which is estimated in the feedback canceller 9, to detect whether the hearing aid 1 is in the ear 12 or not and then, when the hearing aid 1 is detected to be not in the ear 12, the threshold on the motion detection for Auto Off or Auto Low Power can be set higher than without the feedback gain information, such that the Auto Off or Auto Low Power function also works in moving environments such as a moving vehicle.

In an exemplary embodiment, a feedback gain threshold of the feedback gain of about −50 dB may be used to distinguish "in the ear" from "out of ear" conditions.

In an exemplary embodiment, the feedback gain threshold may be varied based on whether the fitting is rather occluded or open. For example, in an open fitting a two sided feedback gain threshold may be used, e.g. the hearing aid 1 may be classified as being in the ear if the feedback gain average is between −40 dB and −30 dB.

Figure 3:
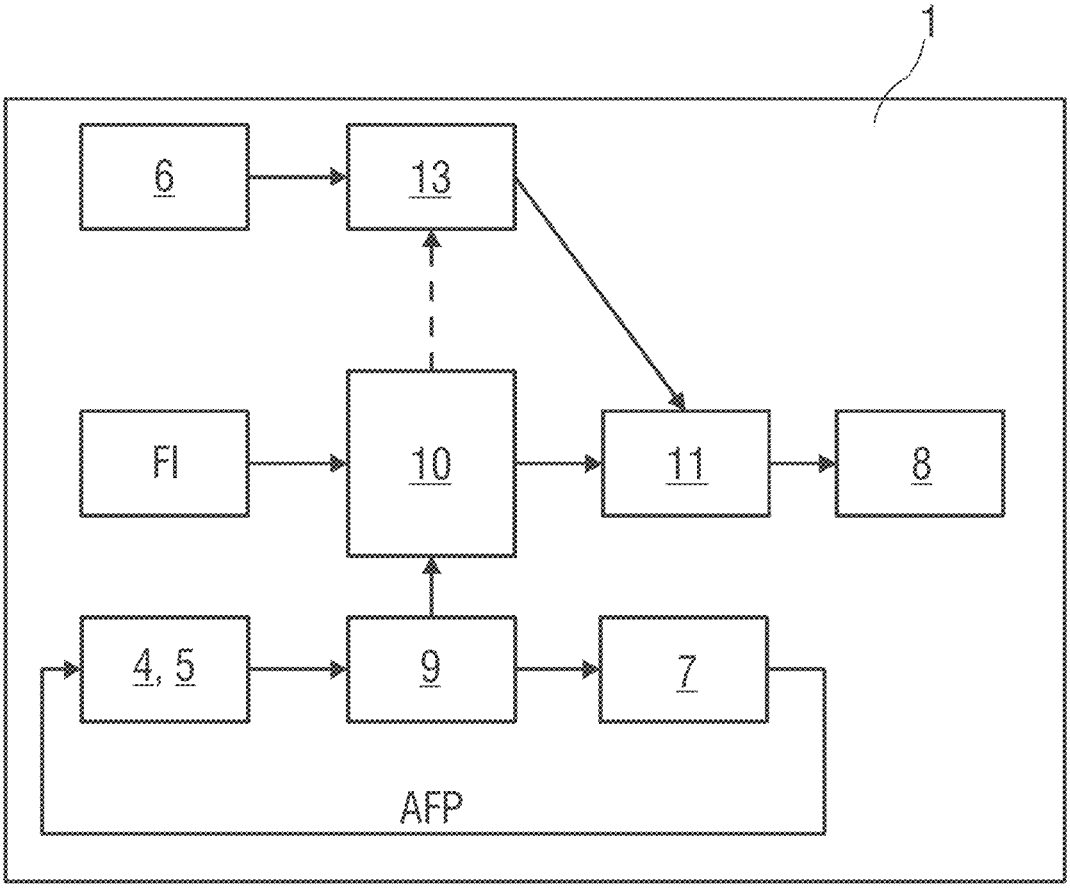
FIG. 3 is a schematic view of a method for controlling a power mode of a hearing aid.

FIG. 3 illustrates a possible method for controlling a power mode of a hearing aid.

In the method, the inertial sensor 6 detects acceleration or movement of the hearing aid 1. The energy in the signals from the inertial sensor 6 may be averaged in a motion detection unit 13. A feedback canceller 9 estimates a feedback gain between an output of the receiver 7 and an input of the one or more microphones 4, 5. The feedback gain is used by an out of ear detector 10 to indicate whether the hearing aid 1 is out of a user's ear. For this purpose, a feedback gain threshold, e.g. −50 dB, may be set to distinguish between an "out of ear" state and an "in the ear" state. The feedback gain threshold may be adapted using fitting information FI stored in the hearing aid 1, e.g. based on whether the fitting of the hearing aid 1 is rather occluded or open. If both the motion detection unit 13 as well as the out of ear detector 10 based on the feedback gain indicate that the hearing aid 1 is out of the user's ear 12, the power mode controller 8 may switch the hearing aid 1 off or into a low power mode.

In an exemplary embodiment, the method to detect whether the hearing aid 1 is in use or not and to power off the hearing aid 1 or switch it into a low power mode when not in use may include using the acoustic input from at least one of the microphones 4, 5 to estimate the feedback gain of an acoustic feedback path AFP from the receiver to the microphone 4, 5 and averaging the feedback gain over time at least in a selected frequency range and comparing to a feedback gain threshold to decide whether the device is in the ear 12, wherein the feedback gain threshold depends on the fitting, in particular the acoustic coupling parameters (i.e. occluded or open fitting).

If the hearing aid 1 is indicated as not in the ear 12 based on the feedback gain then an inertial sensor 6 is used to detect motion by averaging the energy in the acceleration signals and the motion is compared to a motion energy threshold which depends on the "out of ear detection" and the hearing aid 1 is automatically turned off or into a low power mode when the detected motion is below a certain motion energy threshold. If the motion energy threshold is set to a very small value, the motion threshold comparison would effectively be disabled.

In an exemplary embodiment, time constants may be adapted to avoid reacting on short term peaks movement.

When comparing the power spectral density in signals detected by the inertial sensor 6 while the hearing aid 1 is lying on a table against such signals while the hearing aid 1 is in a user's ear 12, even if the user sits as still as possible, it can be seen that in the frequency range between 1 Hz and 10 Hz there is more energy on the ear compared to on the table, which is assumed to originate from body activity such as breathing, blood flow, pulse and the like. By bandpass filtering the signals from the inertial sensor 6 in the range from 1 Hz to 10 Hz and comparing the energy, these two conditions can be distinguished.

This approach may in particular be used in a still environment. In a moving situation such as in a car, bus, train, ship or airplane, this may be more difficult as such vehicles may generate signals having considerable energy levels in this frequency range.

It has been determined that the energy around 10 Hz is lower than around 1 Hz so adjusting the corner frequencies of the bandpass filter 14 in such a condition could still allow to distinguish if the hearing aid 1 is on the ear 12 of a user in the train or if the device is on the table in a train (or another moving vehicle).

Figure 4:
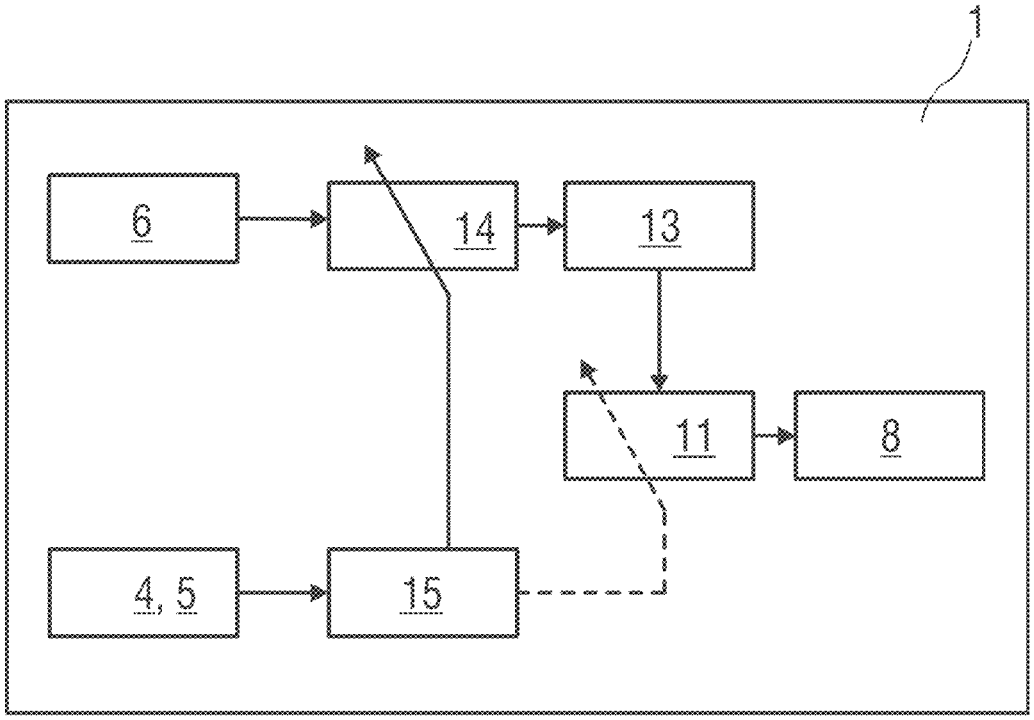
FIG. 4 is a schematic view of a method for controlling a power mode of a hearing aid.

The method to detect whether the hearing aid 1 is in use or not, i.e. worn at the ear 12 or not worn at the ear 12, could thus comprise bandpass filtering the signals from the inertial sensor 6 in a bandpass filter 14 and comparing the averaged energy of the filtered signal to a threshold in a threshold comparison unit 11. The acoustic input from the at least one microphone 4, 5 may be used in an environment classification unit 15 to detect whether the user is likely to be in a car/bus/plane environment (e.g. by low frequency energy detection or other state of the art classification methods) and to adapt the frequency selectivity of the bandpass filter 14 depending on the detected acoustic environment such that typical acceleration patterns from such transportation vehicles are attenuated. FIG. 4 illustrates a possible method for controlling a power mode of a hearing aid.

In the method, the inertial sensor 6 detects acceleration or movement of the hearing aid 1. The signals from the inertial sensor 6 are filtered by the bandpass filter 14. Energy averaging is applied to the filtered signals, e.g. in a motion detection unit 13. The acoustic input from the microphone 4, 5 may be used to detect whether the user is likely to be in a car/bus/plane environment (e.g. by low frequency energy detection or other classification methods) and to adapt the frequency selectivity of the bandpass filter 14 depending on the detected acoustic environment such that typical acceleration patterns from such transportation vehicles are attenuated. If the signals filtered by the bandpass filter 14 and energy averaged are below a set threshold, the hearing aid 1 is classified as being out of the user's ear 12 so the power mode controller 8 may switch the hearing aid 1 off or into a low power mode. Optionally, the threshold could also be adapted based on the detected acoustic environment.

For example, if the microphone input indicates that the user is in a moving vehicle, the corner frequencies of the bandpass filter 14 may be adjusted to range from 7 Hz to 12 Hz. A possible threshold for detecting from the bandpass filtered and energy averaged signals of the inertial sensor 6 if the hearing aid 1 is on the ear 12 or not could be between −54 dB and −60 dB, e.g. −57 dB. The reference of this dB scale may be 1 g.

Figure 5:
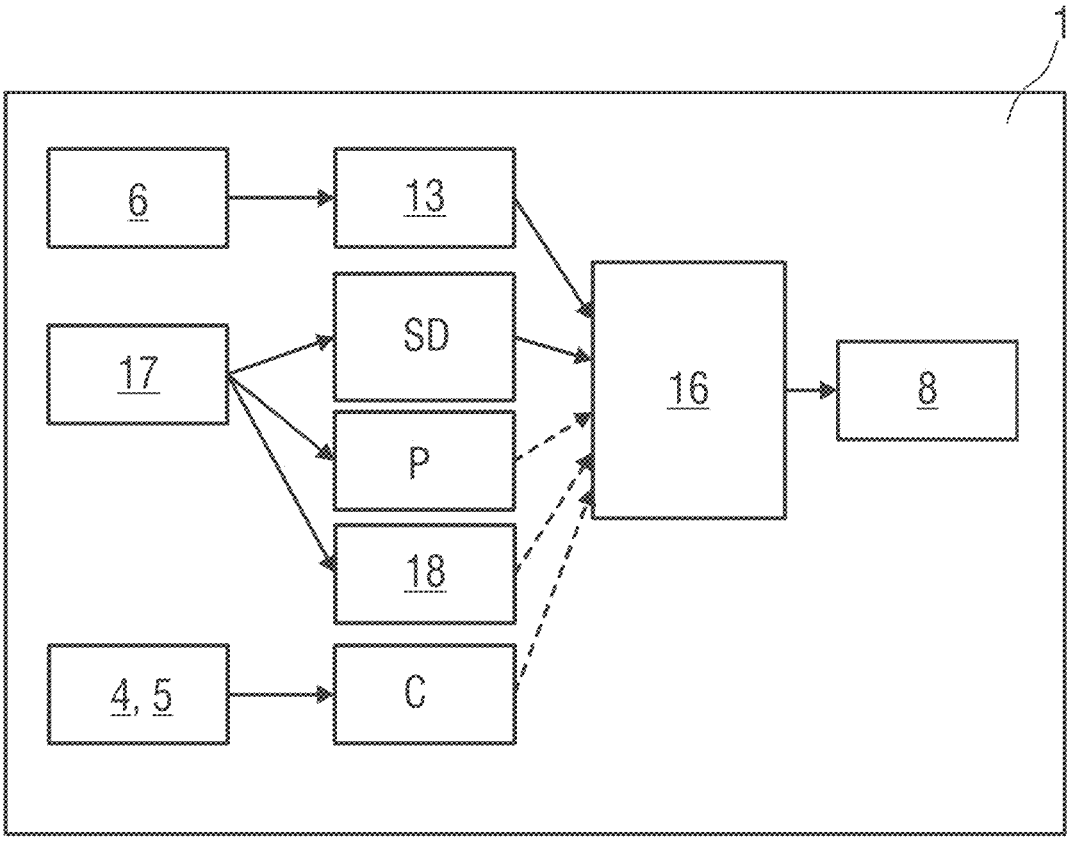
FIG. 5 is a schematic view of a method for controlling a power mode of a hearing aid.

In a further embodiment, a method for controlling a power mode of a hearing aid, illustrated in FIG. 5, is provided to detect if the hearing aid 1 is in a storage box or charger box, e.g. a wireless or contact based charger, but not necessarily connected to power. When the charger is connected to power then the hearing aid 1 has information that it is in the charger and Auto Off is obsolete anyway.

The method applies an inertial sensor 6. In an exemplary embodiment, the charger or storage box may have a cover configured to touch the hearing aid 1 when the cover is being closed. If there are two hearing aids 1, e.g. one for each ear 12 of the user, closing the cover leads to a small synchronous shock in the two hearing aids 1 which can be detected by the respective inertial sensors 6 in the hearing aids 1. The two shocks can be compared by binaural data exchange in a correlation analyzer unit 16 which communicates with the other hearing aid 1 via a wireless interface 17 (latency of wireless data exchange is known) and when the shock data SD of the two shocks detected in the two hearing aids 1 are synchronous the hearing aids 1 are likely to be in the box or charger and can be switched off or into a low power mode.

In a further embodiment the power P of the radio transmission from one to the other hearing aid 1 can be measured and used to detect that the other hearing aid 1 is in proximity which is usually the case in a box or charger for two hearing aids 1. This information can be used without the shock detection or to improve the power mode controller 8 based on shock detection.

In a further embodiment the signals from the at least one microphone 4, 5 can also be evaluated to detect a click C which happens when the charger or box lock snaps in and these detected clicks C can be compared binaurally or be compared with the accelerometer shocks to improve the detection of the hearing aid 1 being in the box or charger to automatically power of the hearing aid 1.

In a further embodiment an NFC chip in the charger or storage box can be used to detect if the at least one hearing aid 1 is in the charger or box. The hearing aid 1 may have an NFC handler 18 connected to the correlation analyzer unit 16 to allow for this detection.

The components having the reference signs 8 to 11 and 13 to 18 described above may be separate units or implemented as software units in the processor 3.

The different ways described above to detect an out of ear condition of a hearing aid 1 may all be applied alone or in combination with any one or any number of the other ways described above.

In all embodiments described above, the hearing aid 1 may comprise a button to switch the hearing aid 1 on and optionally off.

The inertial sensor 6 can comprise an accelerometer and/or a gyroscope.

The signals analysed by the threshold comparison unit 11 or correlation analyzer unit 16 can be acquired directly from the inertial sensor or indirectly via one or more intermediate signal processing components such as filters.

The signal characteristic may comprise at least one of an amplitude, a magnitude, a frequency, and an energy of the signal. The signal characteristic can be representative for the movement detected by the inertial sensor 6, in particular at least one of a motion energy, a velocity, an acceleration, an angular momentum of the hearing aid 1 and/or the like. The signal evaluated by the threshold comparison 11 unit may be filtered, in particular frequency filtered, or unfiltered.

LIST OF REFERENCES

1 hearing aid
2 battery
3 processor
4 first microphone
5 second microphone
6 inertial sensor
7 receiver
8 power mode controller
9 feedback canceller
10 out of ear detector
11 threshold comparison unit
12 ear
13 motion detection unit
14 bandpass filter
15 environment classification unit
16 correlation analyser unit
17 wireless interface
18 NFC handler
AFP acoustic feedback path
C click
FI fitting information
P power
SD shock data

What is claimed is:

1. A hearing aid, comprising:

an inertial sensor for detecting movement of the hearing aid, a power mode controller connected to the inertial sensor through a threshold comparator and adapted to switch the hearing aid off or into a low power mode if the threshold comparator detects that a characteristic of a signal comprising information on the movement detected by the inertial sensor is below a certain threshold, a correlation analyzer connected to a motion detector, a wireless interface, wherein the motion detector is configured to detect an impact shock generated by an impact of a cover of a storage box or charger against the hearing aid when closing the cover, wherein the correlation analyzer is configured for binaural data exchange with another hearing aid having the same configuration through the wireless interface and to share shock data upon detection of the impact shock with the other hearing aid, wherein the correlation analyzer is configured to allow the power mode controller to switch the hearing aid off or into a low power mode upon synchronous detection of impact shocks in both hearing aids.

2. The hearing aid of claim 1, further comprising:

at least one microphone, a receiver, a feedback canceller adapted to determine a feedback gain between the receiver and the at least one microphone, an out of ear detector configured to determine, based on whether the feedback gain is greater than a certain feedback gain threshold, if the hearing aid is in a user's ear or not and, if the hearing aid is determined as not being in the user's ear, to increase the threshold used by the threshold comparator and/or to enable operation of the threshold comparator and/or to alter at least one time constant used by a motion detector to average the signals from the inertial sensor before forwarding them to the threshold comparator.

3. The hearing aid of claim 2, wherein the out of ear detector is configured to use a feedback gain threshold of about −50 dB to distinguish if the hearing aid is in a user's ear or not.

4. The hearing aid of claim 1, wherein the out of ear detector is configured to adapt the feedback gain threshold based on whether the fitting of the hearing aid is rather occluded or open.

5. The hearing aid according to claim 2, wherein the feedback canceller or the out of ear detector is configured to average the feedback gain over time at least in a selected frequency range before comparing with the feedback gain threshold.

6. The hearing aid according to claim 1, wherein a bandpass filter is configured to filter the signals from the inertial sensor to detect body activity of a user.

7. The hearing aid of claim 6, further comprising an environment classifier configured to detect, based on signals from at least one microphone, whether the hearing aid is in a moving vehicle and to:

adapt a frequency selectivity of the bandpass filter in this case such that typical acceleration patterns from moving vehicles are attenuated, and/or adapt the threshold to account for typical acceleration patterns from moving vehicles.

8. The hearing aid according to claim 1, configured to measure a power of the wireless transmission from the other hearing aid wherein the correlation analyzer (16) is alternatively or additionally configured to allow the power mode controller to switch the hearing aid off or into a low power mode if the power is greater than a certain power threshold.

9. A method for controlling a power mode of a hearing aid, comprising:

determining by means of a threshold comparator, if a characteristic of a signal comprising information on a movement detected by an inertial sensor is below a certain threshold and, depending on the determination, switching the hearing aid off or into a low power mode; detecting an impact shock generated by an impact of a cover of a storage box or charger against the hearing aid when closing the cover; binaural data exchange with another hearing aid having the same configuration through a wireless interface to share shock data upon detection of the impact shock with the other hearing aid; and switching the hearing aid off or into a low power mode upon synchronous detection of impact shocks in both hearing aids.

10. The method of claim 9, further comprising:

determining a feedback gain between a receiver and at least one microphone, determining, based on whether the feedback gain is greater than a certain feedback gain threshold, if the hearing aid is in a user's ear or not and, if the hearing aid is determined as not being in the user's ear, to increase the threshold and/or to enable operation of the threshold comparator and/or to alter at least one time constant used to average the signals from the inertial sensor before forwarding them to the threshold comparator.

11. The method of claim 9, further comprising:

adapting the feedback gain threshold based on whether the fitting of the hearing aid is rather occluded or open.

12. The method of claim 9, further comprising bandpass filtering the signals from the inertial sensor to detect body activity of a user.

13. The method of claim 12, further comprising:

detecting, based on signals from at least one microphone, whether the hearing aid is in a moving vehicle and:

adapting a frequency selectivity of the bandpass filter in this case such that typical acceleration patterns from moving vehicles are attenuated, and/or adapting the threshold to account for typical acceleration patterns from moving vehicles.

14. A hearing aid, comprising:

an inertial sensor for detecting movement of the hearing aid, a power mode controller connected to the inertial sensor through a threshold comparator and adapted to switch the hearing aid off or into a low power mode if the threshold comparator detects that a characteristic of a signal comprising information on the movement detected by the inertial sensor is below a certain threshold, a bandpass filter configured to filter signals from the inertial sensor to detect body activity of a user, at least one microphone, an environment classifier configured to detect, based on signals from the at least one microphone, whether the hearing aid is in a moving vehicle and to:

adapt a frequency selectivity of the bandpass filter such that typical acceleration patterns from moving vehicles are attenuated, and/or adapt the threshold to account for typical acceleration patterns from moving vehicles.

15. A method for controlling a power mode of a hearing aid, comprising:

determining by a threshold comparator, whether a characteristic of a signal comprising information on a movement detected by an inertial sensor is below a certain threshold and, depending on the determination, switching the hearing aid off or into a low power mode, bandpass filtering signals from the inertial sensor to detect body activity of a user, detecting, based on signals from at least one microphone, whether the hearing aid is in a moving vehicle and:

adapting a frequency selectivity of the bandpass filter such that typical acceleration patterns from moving vehicles are attenuated, and/or adapting the threshold to account for typical acceleration patterns from moving vehicles.

* * * * *